US007603993B2

(12) United States Patent
Shigematsu

(10) Patent No.: US 7,603,993 B2
(45) Date of Patent: Oct. 20, 2009

(54) INTAKE MODULE

(75) Inventor: Makoto Shigematsu, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/020,768

(22) Filed: Jan. 28, 2008

(65) Prior Publication Data

US 2008/0184975 A1 Aug. 7, 2008

(51) Int. Cl.
*F02B 47/08* (2006.01)

(52) U.S. Cl. ..... 123/568.17

(58) Field of Classification Search ..... 123/568.11, 123/568.17, 568.18, 184.38, 184.43
See application file for complete search history.

(56) References Cited

U.S. PATENT DOCUMENTS

| | | | | |
|---|---|---|---|---|
| 6,668,548 | B1 * | 12/2003 | Asanuma et al. | 60/286 |
| 6,988,478 | B2 * | 1/2006 | Tanikawa et al. | 123/184.42 |
| 7,243,641 | B2 * | 7/2007 | Zukouski | 123/568.17 |

FOREIGN PATENT DOCUMENTS

| | | |
|---|---|---|
| GB | 2 386 158 | 7/2005 |
| JP | 60-252154 | 12/1985 |
| JP | 8-177646 | 7/1996 |
| JP | 2001-132555 | 5/2001 |
| JP | 2006-233859 | 9/2006 |

OTHER PUBLICATIONS

Japanese Office Action dated Jan. 26, 2009, issued in corresponding Japanese Application No. 2007-022725, with English translation.

* cited by examiner

*Primary Examiner*—Stephen K Cronin
*Assistant Examiner*—Keith Coleman
(74) *Attorney, Agent, or Firm*—Nixon & Vanderhye P.C.

(57) ABSTRACT

An intake module includes a surge tank, inflow ports formed from resin integrally with the tank and aligned in one direction of the tank, an intake air leading portion formed at one end portion of the tank in a certain direction and leading intake air into the tank, and a return pipe portion. Each of the ports is connected to a corresponding intake manifold. The certain direction is generally perpendicular to the one direction, and to a flow direction of air flowing into the ports. The return pipe portion is disposed at the other end portion of the tank in the certain direction. The ports are located between the leading portion and the return pipe portion. The return pipe portion communicates between the tank and an exhaust pipe portion, and projects into an inside of the tank. Exhaust air is returned into the tank through the return pipe portion.

3 Claims, 3 Drawing Sheets

INTAKE MODULE

CROSS REFERENCE TO RELATED APPLICATION

This application is based on and incorporates herein by reference Japanese Patent Application No. 2007-22725 filed on Feb. 1, 2007.

BACKGROUND OF THE INVENTION

1. Field of the Invention

The present invention relates to an intake module of an internal-combustion engine.

2. Description of Related Art

In recent years, modularization of functional portions that constitute an inlet system of an internal-combustion engine has been promoted. More specifically, the functional portions such as a surge tank and an intake manifold constituting the inlet system have been formed integrally. By integrating the functional portions constituting the inlet system into a module, the whole module is downsized. The functional portions constituting the inlet system are modularized integrally using resin. Accordingly, reduction in weight of the whole module is achieved.

Recent internal-combustion engines employ exhaust gas recirculation (EGR), whereby exhaust air discharged from the internal-combustion engine is returned to be mixed into intake air, in order to reduce discharged nitrogen oxide and the like. In such an intake module, as described in JP2006-233859A, for example, a return pipe portion through which exhaust air is returned is connected to a surge tank of the intake module.

However, when the returned exhaust air is led into the intake module, the inlet system and an exhaust system need to be connected. Accordingly, complicated treatment needs to be given to piping, so that the whole module is upsized. In the case of an internal-combustion engine for a vehicle, in particular, a space, in which the internal-combustion engine is installed, is severely constrained. Thus, downsizing of the intake module is strongly demanded.

SUMMARY OF THE INVENTION

The present invention addresses the above disadvantages. Thus, it is an objective of the present invention to provide an intake module that can be downsized.

To achieve the objective of the present invention, there is provided an intake module for distributing intake air among a plurality of intake manifolds connected to an engine. The module includes a surge tank, a plurality of inflow ports, an intake air leading portion, and a return pipe portion. The surge tank has a container-like shape. The plurality of inflow ports is formed from resin integrally with the surge tank and is aligned in one direction of the surge tank. Each of the plurality of inflow ports is connected to a corresponding one of the plurality of intake manifolds. The intake air leading portion is formed at one end portion of the surge tank in a certain direction and leads intake air into the surge tank. The certain direction is generally perpendicular to the one direction in which the plurality of inflow ports is aligned. The certain direction is generally perpendicular to a flow direction of air flowing into the plurality of inflow ports. The return pipe portion is disposed at the other end portion of the surge tank in the certain direction, such that the plurality of inflow ports is located between the intake air leading portion and the return pipe portion. The return pipe portion communicates between the surge tank and an exhaust pipe portion, through which exhaust air discharged from the engine flows, and projects into an inside of the surge tank, so that exhaust air in the exhaust pipe portion is returned into the inside of the surge tank through the return pipe portion.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
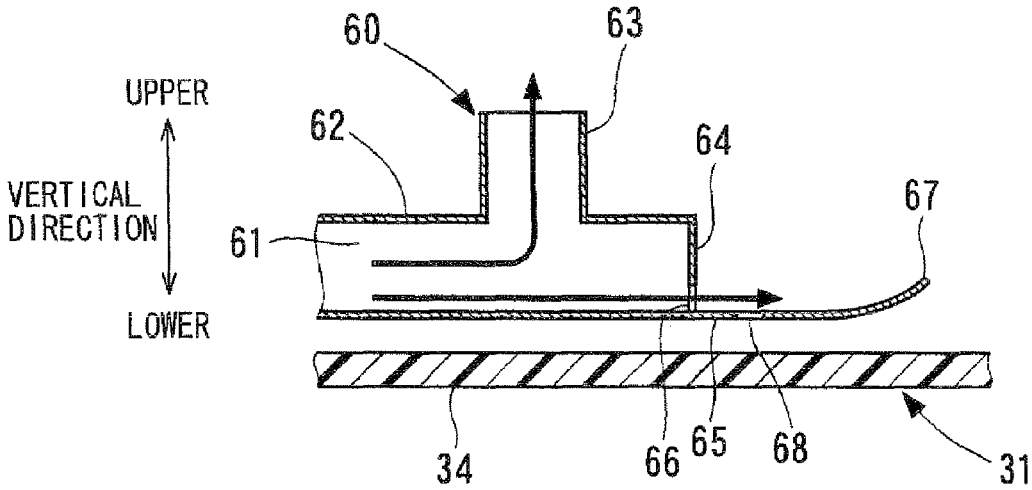
FIG. 1 is a schematic enlarged sectional view illustrating an area near a return pipe portion in an intake module according to an embodiment of the invention.

According to an example of the invention, a return pipe portion is provided at an end portion of a surge tank on an opposite side of an intake air leading portion in a certain direction that is generally perpendicular to a direction in which inflow ports are aligned as well as to a flow direction of air flowing into the inflow ports. In other words, the intake air leading portion is disposed at one end portion of the surge tank, and the return pipe portion is disposed at the other end portion of the surge tank in the certain direction. The portion of the surge tank on the opposite side of the intake air leading portion in the certain direction serves simply as a volume portion of the surge tank, and is accordingly a dead space. In the example, by providing a part through which intake air flows into the surge tank and a part through which returned exhaust air flows into the surge tank, at both end portions of the surge tank in the certain direction, respectively, piping through which the intake air and the returned exhaust air flow has simplified shapes, and the return pipe portion is disposed in the dead space of the surge tank. Thus, the piping structure is simplified, and accordingly the whole intake module is downsized. In the example, the intake air leading portion and the return pipe portion are disposed at both end portions of the surge tank in the certain direction. As a result, the intake air led by the intake air leading portion and the exhaust air led by the return pipe portion are mixed together in the surge tank. Thus, a concentration of the exhaust air in air flowing through the inflow ports is made homogeneous.

When the exhaust air is returned to the surge tank of a modularized inlet system, it is necessary that the intake module including the surge tank need to be located near the return pipe portion through which the returned exhaust air flows due to a spatial constraint near an internal-combustion engine. As the intake module is further downsized, reduction in a distance between each member becomes marked. However, since exhaust air flowing through an exhaust pipe portion is at high temperature, such as at 100° C. and above, the exhaust air discharged from the exhaust pipe portion may thermally damage the intake module including the surge tank, which is made of resin. The exhaust air is difficult to discharge in an axial direction of the return pipe portion, and accordingly, a pipe portion branching from a halfway portion of the return pipe portion needs to be provided to discharge the exhaust air through the pipe portion in a direction perpendicular to the axis of the return pipe portion. When the pipe portion branches from the halfway portion of the return pipe portion, the return pipe portion is closed at its end portion, and water is accumulated at the end portion as a result of the condensation of water included in the exhaust air. The water may corrode the return pipe portion, which is formed from metal. Accordingly, it is proposed providing a hole portion, through which the condensate water is discharged, on a portion of the return pipe portion. Nevertheless, high-temperature exhaust air is discharged through the hole portion together with the condensate water. As a result, a sidewall of the surge tank may be thermally damaged. Therefore, a space needs to be ensured between the return pipe portion and the sidewall, and this space results in upsizing of the intake module.

In the example, a wall portion having an opening is provided at an end portion of a cylindrical portion. The condensate water accumulated in the cylindrical portion is discharged into the outside through the opening of the wall portion in an axial direction of a return passage. The condensate water discharged from the return passage flows, together with the exhaust air discharged through the opening, along a projecting plate portion, and then drops through a hole portion of the projecting plate portion. Since the exhaust air is discharged from a branch portion into the inside of the surge tank, pressure is the same at both sides of the projecting plate portion, which is located outside an exhaust passage, with the hole portion therebetween. As a result, even though the exhaust air including the condensate water flows along the projecting plate portion, only the condensate water drops toward a sidewall-side through the hole portion and the exhaust air flows into the inside of the surge tank along the projecting plate portion. Thus, the high-temperature exhaust air does not squirt toward the sidewall-side. Consequently, the corrosion of the return pipe portion caused by the condensate water is prevented, and the thermal damage to the sidewall is reduced.

In the example, the projecting plate portion has a guide portion, which is bent toward an opposite side of the sidewall. Accordingly, the exhaust air discharged through the opening of the wall portion is led in a direction away from the sidewall by the guide portion. Then, the exhaust air is evenly mixed with the intake air led by the intake air leading portion. Thus, the exhaust air supplied to each of the inflow ports is made uniform.

Furthermore, the intake air leading portion is located on an upper side in a vertical direction, and the return pipe portion is located on a lower side in the vertical direction when the intake module is installed in a vehicle. Therefore, a space, in which the internal-combustion engine of the vehicle is installed, is effectively utilized.

An embodiment of the invention is described below with reference to drawings.

Figure 2:
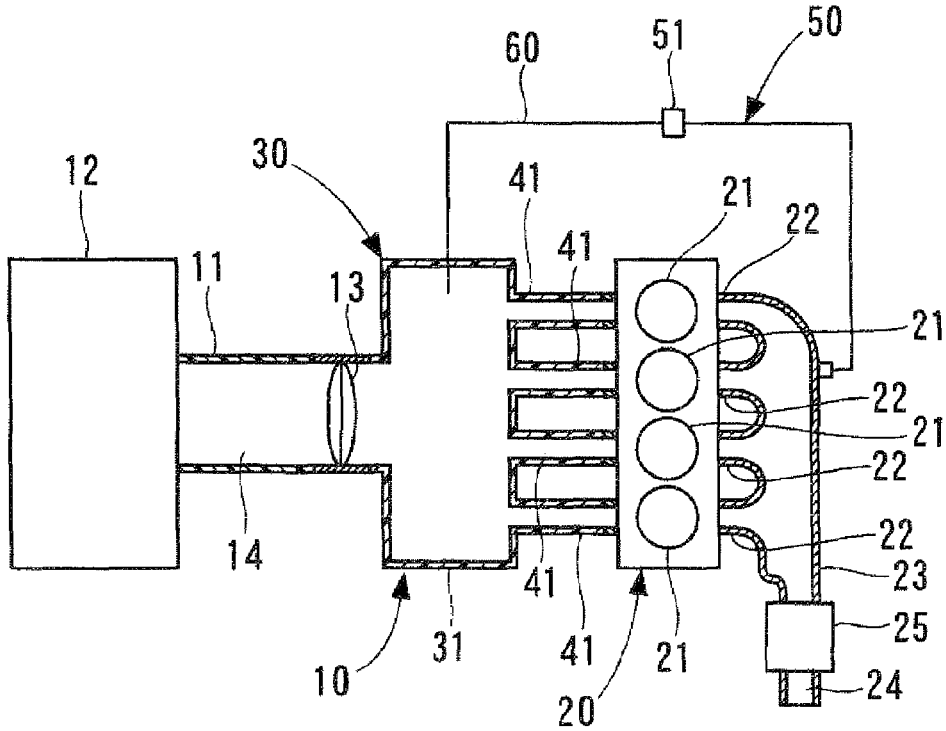
FIG. 2 is a schematic view illustrating an engine system, to which the intake module according to the embodiment is applied.

As shown in FIG. 2, an engine system 10 includes an intake module 30, an intake pipe portion 11, an air cleaner 12, and a gasoline engine (engine) 20 as an internal-combustion engine. The intake module 30 has a surge tank 31, from which an intake manifold 41 branches according to the number of cylinders of the engine 20 and is connected to each of cylinders 21 of the engine 20.

The air cleaner 12 is disposed at an end portion of the intake module 30 on an opposite side of the engine 20. The air cleaner 12 receives an air cleaner element (not shown). Foreign substances are removed from air that is suctioned into the engine 20 while the air is flowing through the air cleaner 12. The air that is suctioned into the engine 20 is drawn through the air cleaner 12. Thus, the air cleaner 12 serves as an inlet, through which air is drawn into the intake module 30.

The intake pipe portion 11 is provided between the surge tank 31 of the intake module 30 and the air cleaner 12. A throttle 13, which opens or closes an intake passage 14 defined by the intake pipe portion 11, is disposed in the intake pipe portion 11. The intake pipe portion 11, the surge tank 31, and the intake manifold 41 constitute the intake passage 14, which connects the air cleaner 12 and each of the cylinders 21 of the engine 20. The throttle 13 regulates a flow of intake air flowing through the intake passage 14. Air that has flowed through the air cleaner 12 flows into the surge tank 31 through the intake passage 14. The air that has flowed into the surge tank 31 is supplied to each of the cylinders 21 through the intake manifold 41.

The engine 20 is connected not only to an inlet system including the intake module 30 but also to an exhaust system. A portion of the engine 20 on an opposite side of the inlet system is connected to an exhaust manifold 22 and an exhaust pipe portion 23. The exhaust manifold 22 is connected to each of the cylinders 21, and exhaust air discharged from each of the cylinders 21 flows through the exhaust manifold 22. The exhaust manifold 22 merges together at the exhaust pipe portion 23. The exhaust manifold 22 and the exhaust pipe portion 23 constitute an exhaust passage 24. The exhaust air, which has been discharged from each of the cylinders 21, is discharged into the outside of the engine 20 through the exhaust passage 24. An end portion of the exhaust pipe portion 23 on the opposite side of the engine 20 serves as an exhaust outlet, through which exhaust air is discharged. A catalyst 25, which reduces or oxidizes unburnt hydrocarbon (HC), nitrogen oxide (NOx), and sulfur oxide (SOx) in exhaust air, is disposed halfway through the exhaust pipe portion 23.

An exhaust gas recirculation (EGR) unit 50 is disposed between the inlet system and the exhaust system of the engine system 10. The EGR unit 50 has a return pipe portion 60, which connects the exhaust system and the inlet system. As shown in FIG. 1, the return pipe portion 60 defines a return passage 61, which connects the exhaust passage 24 and the surge tank 31. As shown in FIG. 2, the EGR unit 50 has a control valve 51 halfway through the return pipe portion 60. The control valve 51 regulates a flow of exhaust air returning from the exhaust passage 24 into the surge tank 31 through the return passage 61. A part of exhaust air discharged from the engine 20 is returned into the surge tank 31 through the EGR unit 50, and then, together with intake air suctioned through the air cleaner 12, the part of exhaust air is supplied again to the engine 20.

Figure 3:
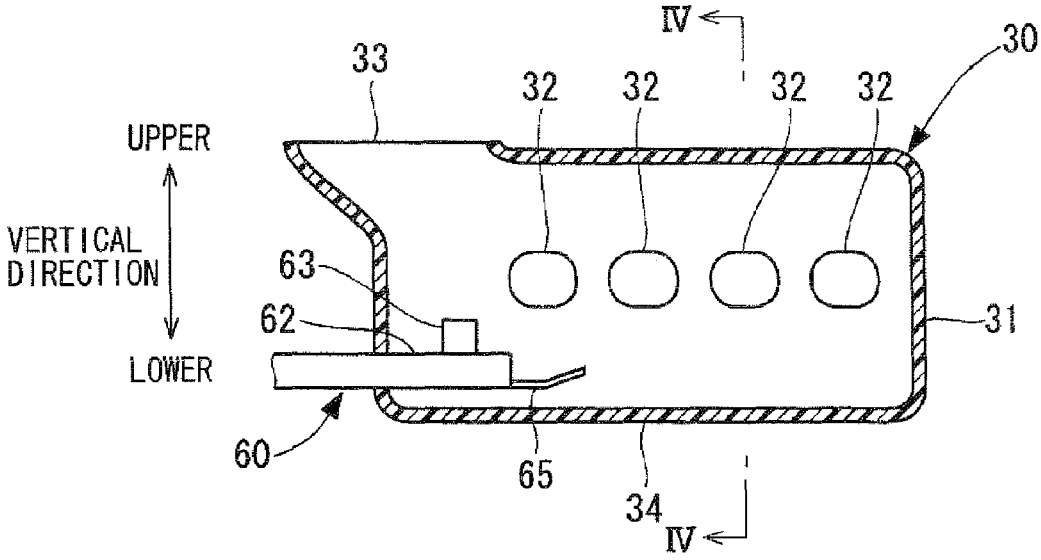
FIG. 3 is a schematic sectional view illustrating the intake module according to the embodiment.
Figure 4:
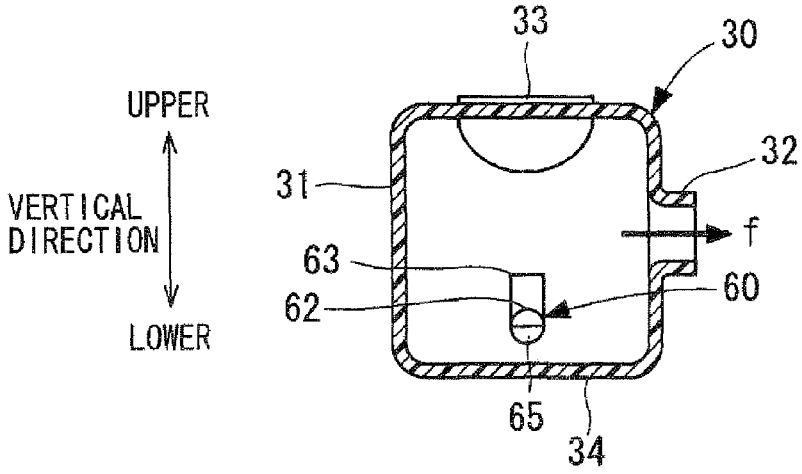
FIG. 4 is a schematic sectional view taken along a line IV-IV in FIG. 3.

As shown in FIGS. 3, 4, the intake module 30 has the surge tank 31 constituting the inlet system, inflow ports 32 connected to the intake manifold 41, an intake air leading portion 33, and the return pipe portion 60. As shown in FIG. 2, the surge tank 31 is a volume portion located halfway through the intake passage 14 connecting the air cleaner 12 and the engine 20. As shown in FIG. 3, the same number of the inflow ports 32 as the cylinders 21 are provided corresponding to the intake manifold 41. Additionally, the intake manifold 41 may be formed by extending directly from the intake module 30. The intake module 30 may be made by integrally forming the surge tank 31 and the inflow ports 32 from resin.

The inflow ports 32 are aligned corresponding to the intake manifold 41. When the engine 20 has four cylinders, for example, four inflow ports 32 are aligned corresponding to a quadruply-branched intake manifold 41. Accordingly, as shown in FIG. 3, the inflow ports 32 are aligned in one direction of the surge tank 31. Air that has flowed into the surge tank 31 flows out into the intake manifold 41 through the inflow ports 32. As indicated by an arrow F in FIG. 4, the air flowing out of the surge tank 31 into the intake manifold 41 flows generally perpendicular to a direction in which the inflow ports 32 are aligned.

The intake air leading portion 33 is formed at one end portion of the intake module 30 in a certain direction that is generally perpendicular to, the direction in which the inflow ports 32 are aligned as well as a flow direction of air flowing into the inflow ports 32, that is, in an upper/lower direction in FIGS. 3, 4. The certain direction corresponds to the upper/lower direction in FIGS. 3, 4, and the upper/lower direction corresponds to a vertical direction with respect to gravity. Accordingly, an upper side in FIGS. 3, 4 is an upper side in the vertical direction, and a lower side in FIGS. 3, 4 is a lower side in the vertical direction. In the present embodiment, when the intake module 30 is installed in a vehicle, the vertical direction in FIGS. 3, 4 accords with a vertical direction while in the vehicle.

The intake module 30 has the return pipe portion 60 on an opposite side of the intake air leading portion 33 in the certain direction, that is, in the upper/lower direction in FIGS. 3, 4. In other words, the intake module 30 has the return pipe portion 60 on the lower side. As described above, the return pipe portion 60 constitutes the EGR unit 50 as well. An end portion of the return pipe portion 60 on an opposite side of the surge tank 31 is connected to the exhaust pipe portion 23. As shown in FIG. 1, the return pipe portion 60 has a cylindrical portion 62, a branch portion 63, a wall portion 64, and a projecting plate portion 65. The return pipe portion 60 may be formed from a material (e.g., metal) having high heat resistance to high-temperature exhaust air.

The cylindrical portion 62 defines the return passage 61, which is connected to the exhaust passage 24 defined by the exhaust pipe portion 23. As shown in FIG. 3, an end portion of the cylindrical portion 62 on an opposite side of the exhaust system projects into the inside of the surge tank 31. As shown in FIG. 1, the cylindrical portion 62 is provided near a sidewall 34 on the opposite side of the intake air leading portion 33 of the surge tank 31. The cylindrical portion 62 has the wall portion 64 at its end portion on an opposite side of the exhaust passage 24, that is, at the end portion located in the inside of the surge tank 31 in an axial direction of the cylindrical portion 62. The wall portion 64 has an opening 66 on a side of the sidewall 34 of the surge tank 31. Through the wall portion 64, the opening 66 communicates between the return passage 61 and the outside of the cylindrical portion 62. Thus, the wall portion 64 blocks the end portion of the cylindrical portion 62 except the opening 66.

The branch portion 63 branches from a halfway portion of the cylindrical portion 62. Together with the cylindrical portion 62, the branch portion 63 defines the return passage 61. Most of the exhaust air flowing through the return passage 61 is discharged into the inside of the surge tank 31 through the inside of the branch portion 63. The branch portion 63 branches radially outward of the cylindrical portion 62 in a direction generally perpendicular to an axis of the cylindrical portion 62.

The projecting plate portion 65 projects from the end portion of the cylindrical portion 62 on a wall portion 64-side in the axial direction of the cylindrical portion 62. The projecting plate portion 65 is formed in a plate-like shape, and provided integrally with the cylindrical portion 62 at its end portion on a sidewall 34-side. Accordingly, the projecting plate portion 65 extends along the sidewall 34. As a result of providing the projecting plate portion 65, exhaust air that has flowed from the return passage 61 through the opening 66 flows along the projecting plate portion 65. The projecting plate portion 65 has a guide portion 67 at its apical portion that is, at its end portion on an opposite side of the cylindrical portion 62. The guide portion 67 is bent toward an upper side in FIG. 1 such that its end portion is distanced from the sidewall 34. Accordingly, exhaust air flowing along the projecting plate portion 65 is led by the guide portion 67 to flow out toward the inflow ports 32. The projecting plate portion 65 has a hole portion 68 at its halfway portion. The hole portion 68 penetrates through the projecting plate portion 65 in its thickness direction.

A flow of the returned exhaust air in the intake module 30 having the above configuration is described below.

Most of the exhaust air that has flowed into the return passage 61 defined by the cylindrical portion 62 is discharged into the inside of the surge tank 31 through the branch portion 63. The exhaust air discharged from the branch portion 63 flows toward the upper side in FIGS. 1, 3, that is, toward the intake air leading portion 33. As a result, a mixture of the exhaust air discharged from the branch portion 63 and intake air suctioned through the intake air leading portion 33 is promoted. Thus, exhaust air distributed among the inflow ports 32 is made uniform.

On the other hand, a part of the exhaust air flowing along the return passage 61 flows out through the opening 66, and then flows along a surface of the projecting plate portion 65 on an opposite side of the sidewall 34. The exhaust air that has flowed out through the opening 66 is led by the projecting plate portion 65 and the guide portion 67 to flow toward the upper side in FIG. 1, that is, toward the inflow ports 32. Consequently, a mixture of the exhaust air flowing out through the opening 66 and the intake air suctioned through the intake air leading portion 33 is also promoted. Thus, in the case where the opening 66 is formed as well, exhaust air distributed among the inflow ports 32 is made uniform.

The exhaust air returned from the exhaust system includes water due to combustion of fuel. The water is included in the form of water vapor in high-temperature exhaust air, but with decreasing temperature, liquefies as condensate water. The condensation of water vapor is promoted further in the inside of the surge tank 31 where the temperature is low. When temperature of exhaust air or temperature in the return pipe portion 60 is low, such as when the engine 20 is started, particularly, condensate water is easily produced near the end portion of the cylindrical portion 62, that is, near the wall portion 64.

In the present embodiment, a part of the exhaust air flowing along the return passage 61 flows out through the opening 66. Meanwhile, the condensate water produced near the wall portion 64 is discharged into the outside of the cylindrical portion 62, that is, toward the projecting plate portion 65 by the exhaust air flowing out through the opening 66. The condensate water discharged into the projecting plate portion 65-side is carried along the projecting plate portion 65 by a flow of exhaust air, and then reaches the hole portion 68. The condensate water that has reached the hole portion 68 drops to the side of the sidewall 34 of the surge tank 31 through the hole portion 68. Since the projecting plate portion 65 is located outside the cylindrical portion 62, the inside of the surge tank 31 has generally equal pressure between on the sidewall 34-side and on an opposite side of the sidewall 34_with the hole portion 68 therebetween. Accordingly, exhaust air does not flow out toward the sidewall 34-side through the hole portion 68, and only the condensate water drops toward the sidewall 34-side. As a result, the condensate water in the cylindrical portion 62 constituting the return pipe portion 60, and on the projecting plate portion 65 is reduced.

Figure 5:
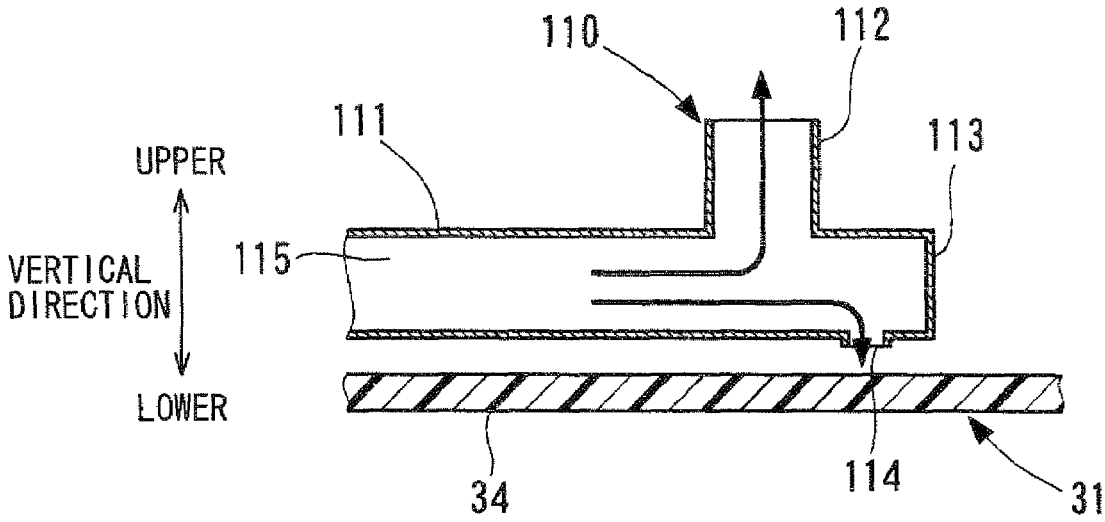
FIG. 5 is a schematic enlarged sectional view illustrating an area near a return pipe portion in a comparative example of the intake module.

A comparative example is described below. Similar to the intake module 30 of the present embodiment, an intake module employing the comparative example shown in FIG. 5 has a return pipe portion 110 on the opposite side of the intake air leading portion 33 in a vertical direction. The return pipe portion 110 has a cylindrical portion 111 and a branch portion 112. An end portion of the cylindrical portion 111 is blocked by a wall portion 113. In the comparative example, a portion corresponding to the projecting plate portion 65 is not provided. Furthermore, a hole portion 114 is formed at a halfway portion of the cylindrical portion 111 in its axial direction. The hole portion 114 extends through the cylindrical portion 111 in its thickness direction, that is, in its radial direction.

In the above comparative example, water included in exhaust air flowing through a return passage 115 defined by the return pipe portion 110 condenses near the wall portion 113. Meanwhile, a part of exhaust air flowing through the return passage 115 is discharged into the outside of the cylindrical portion 111 through the hole portion 114. Accordingly, the condensate water produced near the wall portion 113 is discharged into the outside, together with the exhaust air flowing through the hole portion 114. Since pressure is lower in the surge tank 31 outside the cylindrical portion 111 than in the return passage 115 formed on an inner circumferential side of the cylindrical portion 111, not only the condensate water but the part of exhaust air is discharged through the hole portion 114. As a result, the high-temperature exhaust air discharged through the hole portion 114 together with the condensate water is blown into the sidewall 34 of the surge tank 31, which is opposed to the hole portion 114. Thus, the sidewall 34 is likely to be damaged thermally. When a distance between the return pipe portion 110 and the sidewall 34 is made large in order to prevent the thermal damage to the sidewall 34, the intake module may grow in size. Furthermore, the exhaust air discharged through the hole portion 114 is blown into the sidewall 34, and consequently it is difficult for the discharged exhaust air to be mixed with intake air suctioned through the intake air leading portion 33. Hence, the even distribution of exhaust air among the inflow ports 32 is difficult.

In the present embodiment, by comparison with the above comparative example, exhaust air including condensate water is discharged from the return passage 61 defined by the cylindrical portion 62 into the projecting plate portion 65-side outside the cylindrical portion 62. Accordingly, a difference between pressures on both sides of the hole portion 68 formed on the projecting plate portion 65 is small. Thus, the high-temperature exhaust air flowing along the projecting plate portion 65 does not flow out toward the sidewall 34-side through the hole portion 68, and is led by the projecting plate portion 65 and the guide portion 67 to be mixed with the intake air suctioned through the intake air leading portion 33. The high-temperature exhaust air is not blown into the sidewall 34, so that the thermal damage to the sidewall 34 is prevented without upsizing the surge tank 31. In addition, the exhaust air discharged through the opening 66 is led by the projecting plate portion 65 and the guide portion 67 to be mixed with intake air. Therefore, exhaust air is evenly distributed to the intake air flowing into each of the inflow ports 32.

In the present embodiment, the return pipe portion 60 is provided on the lower side of the surge tank 31 in the vertical direction. The lower side of the surge tank 31 serves simply as a volume portion, and is accordingly a dead space. By providing the return pipe portion 60 on the lower side of the surge tank 31, the dead space is effectively utilized. As a result, even within a spatial constraint such as in a vehicular engine room, the return pipe portion 60 is connected to the surge tank 31 without complicating the structure of the return pipe portion 60. Therefore, the whole intake module 30 is not upsized, and thereby the intake module 30 is easily installed.

Furthermore, the condensate water produced inside the return pipe portion 60 is discharged into the outside of the return pipe portion 60. Accordingly, damage to the return pipe portion 60 such as corrosion on the return pipe portion 60 is reduced.

In the present embodiment described above, the intake module 30 is applied to the four-cylinder engine 20. However, the intake module 30 may be applied not only to the four-cylinder engine but also to any-cylinder engine.

The invention is not limited to the above embodiment, and may be applied to various embodiments without departing from the scope of the invention.

Additional advantages and modifications will readily occur to those skilled in the art. The invention in its broader terms is therefore not limited to the specific details, representative apparatus, and illustrative examples shown and described.

What is claimed is:

1. An intake module for distributing intake air among a plurality of intake manifolds connected to an engine, the module comprising:

a surge tank having a container-like shape;

a plurality of inflow ports formed from resin integrally with the surge tank and aligned in one direction of the surge tank, wherein each of the plurality of inflow ports is connected to a corresponding one of the plurality of intake manifolds;

an intake air leading portion formed at one end portion of the surge tank in a certain direction and leading intake air into the surge tank, wherein:

the certain direction is generally perpendicular to the one direction in which the plurality of inflow ports is aligned; and the certain direction is generally perpendicular to a flow direction of air flowing into the plurality of inflow ports; and a return pipe portion disposed at the other end portion of the surge tank in the certain direction, such that the plurality of inflow ports is located between the intake air leading portion and the return pipe portion, wherein the return pipe portion communicates between the surge tank and an exhaust pipe portion, through which exhaust air discharged from the engine flows, and projects into an inside of the surge tank, so that exhaust air in the exhaust pipe portion is returned into the inside of the surge tank through the return pipe portion, wherein:

the return pipe portion is disposed near a sidewall of the surge tank located on an opposite side of the intake air leading portion in the certain direction;

the return pipe portion protects into the inside of the surge tank in a direction that is generally parallel to the one direction in which the plurality of inflow ports is aligned;

the return pipe portion includes:

a cylindrical portion defining a return passage through which exhaust air flows;

a branch portion branching from the cylindrical portion radially outward of the cylindrical portion to communicate with the inside of the surge tank;

a wall portion formed at an end portion of the cylindrical portion on a surge tank-side, wherein:

the wall portion has an opening on a sidewall-side; and the wall portion blocks an end portion of the return passage on the surge tank-side except the opening; and a projecting plate portion having a plate-like shape and extending from the end portion of the cylindrical portion on the surge tank-side along the sidewall in a direction that is generally parallel to the one direction in which the plurality of inflow ports is aligned, wherein the projecting plate portion has a hole portion penetrating through the projecting plate portion in a thickness direction thereof.

2. The intake module according to claim 1, wherein:

the projecting plate portion has a guide portion at an end portion of the projecting plate portion located on an opposite side of the cylindrical portion; and the guide portion is bent toward an opposite side of the sidewall.

3. An intake module for distributing intake air among a plurality of intake manifolds connected to an engine, the module comprising:

a surge tank having a container-like shape;

a plurality of inflow ports formed from resin integrally with the surge tank and aligned in one direction of the surge tank, wherein each of the plurality of inflow ports is connected to a corresponding one of the plurality of intake manifolds;

an intake air leading portion formed at one end portion of the surge tank in a certain direction and leading intake air into the surge tank, wherein:

the certain direction is generally perpendicular to the one direction in which the plurality of inflow ports is aligned; and the certain direction is generally perpendicular to a flow direction of air flowing into the plurality of inflow ports; and a return pipe portion disposed at the other end portion of the surge tank in the certain direction, such that the plurality of inflow ports is located between the intake air leading portion and the return pipe portion, wherein the return pipe portion communicates between the surge tank and an exhaust pipe portion, through which exhaust air discharged from the engine flows, and projects into an inside of the surge tank, so that exhaust air in the exhaust pipe portion is returned into the inside of the surge tank through the return pipe portion, wherein:

the certain direction generally accords with a vertical direction; and when the intake module is installed in a vehicle, the intake air leading portion is located on an upper side in the vertical direction, and the return pipe portion is located on a lower side in the vertical direction.

* * * * *

UNITED STATES PATENT AND TRADEMARK OFFICE

CERTIFICATE OF CORRECTION

PATENT NO. : 7,603,993 B2
APPLICATION NO. : 12/020768
DATED : October 20, 2009
INVENTOR(S) : Shigematsu It is certified that error appears in the above-identified patent and that said Letters Patent is hereby corrected as shown below:

Title Page, Item (30) should be inserted to read
--(30) Feb. 1, 2007 (JP) ..... 2007-22725--

Signed and Sealed this

Second Day of February, 2010

David J. Kappos

David J. Kappos
*Director of the United States Patent and Trademark Office*